US006592715B2

(12) United States Patent
Halmschlager et al.

(10) Patent No.: US 6,592,715 B2
(45) Date of Patent: Jul. 15, 2003

(54) DEVICE FOR THE PRODUCTION OF A MULTI-LAYER FIBER STOCK WEB

(75) Inventors: Günter Halmschlager, Krems (AT); Klaus Wulz, St. Pölten (DE); Christoph Haase, Neulengbach (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/864,730

(22) Filed: May 24, 2001

(65) Prior Publication Data

US 2002/0060037 A1 May 23, 2002

(30) Foreign Application Priority Data

May 25, 2000 (DE) ..... 100 25 896

(51) Int. Cl.[7] ..... D21F 11/04

(52) U.S. Cl. ..... 162/132; 162/123; 162/300; 162/303; 162/304; 162/306; 162/133

(58) Field of Search ..... 162/133, 132, 162/299, 300, 303, 304, 306, 307

(56) References Cited

U.S. PATENT DOCUMENTS

| | | | | |
|---|---|---|---|---|
| 1,581,656 A | * | 4/1926 | Monaghan | 162/307 |
| 5,468,348 A | * | 11/1995 | Blackledge et al. | 162/132 |

FOREIGN PATENT DOCUMENTS

| | | | |
|---|---|---|---|
| DE | 2 023 520 | 12/1971 | D21F/9/02 |
| DE | 70 45 015 | 1/1975 | D21F/9/02 |
| WO | WO 92/05310 | 4/1992 | D21F/11/04 |

* cited by examiner

*Primary Examiner*—Peter Chin
(74) *Attorney, Agent, or Firm*—Taylor & Aust, P.C.

(57) ABSTRACT

A machine for the production of a multi-layer fiber stock web, specifically a paper or cardboard web, whereby a first and a second layer are couched as a result of being delivered by an associated forming belt or wire to a couching element around which a second forming belt, or wire delivering the second layer is guided. This second forming belt, or wire impacts/runs onto the couching element before the second layer, which is supported by it, makes contact with the first layer. The second layer, at least in the location where it comes into contact with the first layer, is retained through suction force to the second forming belt wire.

20 Claims, 2 Drawing Sheets

DEVICE FOR THE PRODUCTION OF A MULTI-LAYER FIBER STOCK WEB

BACKGROUND OF THE INVENTION

1. Field of the Invention

The invention relates to a machine for the production of a multi-layer fiber stock web, specifically a paper or cardboard web.

2. Description of the Related Art

Couching of various layers during paper production has hitherto been accomplished by a couching roll, which is typically designed as a perforated cylinder. The forming belt, together with the second layer, or fiber stock web on it, are guided around this roll so that the roll is submerged into the continuous ribbon which is formed by a forming belt or wire supporting the first fiber stock web. Pressure resulting from the tension of the forming belt or wire supporting the first fiber stock web or layer is exerted upon both layers or fiber stock webs.

Prior to couching of a fiber stock web, the second fiber stock web is held to the couch roll only by the binding forces between the second fiber stock web and the second forming belt or wire.

In machinery and methods of the type known in the art there is the risk at high speeds, that the second fiber stock web will separate from the second forming belt or wire prior to couching, due to centrifugal force. This may result in a tangential throwing off of the fiber stock web, resulting in a related waste factor.

What is needed in the art is a device for the production of a multi-layer fiber stock web which would ensure that the second layer does not separate from the forming belt, or wire in the critical area prior to couching.

SUMMARY OF THE INVENTION

The present invention provides a device and method in which the second fiber stock layer, in the area prior to the point at which it comes into contact with the first fiber stock layer, is drawn with suction force to the second forming belt, or wire. The second fiber stock layer is admitted specifically in the direction of the couching element. This second fiber stock layer is admitted in an area toward the second forming belt or wire, where this forming belt or wire is in contact with the couching element, or in the area it is diverted by the couch element, or in the area in which it wraps around the couch element.

This simple and reliable method ensures that the second layer does not separate from the second forming belt or wire in the critical area prior to couching. The appropriate handling additionally ensures that the web's dry content is increased.

In another embodiment of the invention, the couch element is formed by a support element having a surface area which is at least partially open faced and this support element is operated with an interior pressure which is lower than the ambient pressure. The couch element may, for example be a suction roll, a perforated cylinder or a shoe.

Advantageously, the second layer can be subjected to a suction force, which is produced by at least one suction zone in the couch element.

Following the couch element, the forming belt or wire delivering the first layer accepts the second layer. The second forming belt or wire is appropriately separated from the first forming belt or wire in the discharge area of the couch element.

In order to ensure delivery of the web, even at high speeds, it is advantageous if the second layer, in the area in which the two forming belts or wires exit from the couch element, can be pushed away from the couch element by means of fluid over pressure. This second layer separation from a forming belt may specifically be accomplished with air and/or steam. If steam is utilized as the pressure fluid, then a viscosity change of the two couched layers occurs enhancing the subsequent dewatering of the web. For example, a steam blow box or similar device may be provided.

In yet another embodiment of the invention, the fluid excess pressure is produced by at least one pressure zone in the couch element.

The method according to the invention is characterized by the second layer being directed specifically through suction force toward the second forming belt or wire, prior to the point at which it comes into contact with the first layer.

The invention may also be utilized specifically at machinery speeds of higher than 1000 m/min. The fiber stock webs that are to be couched may be created by optional methods, using optional formers (i.e. hybrid formers, gap formers, long wires, crescent formers, etc.), for example, the following Voith Sulzer formers may be utilized: DuoFormer Base, DuoFormer Top, DuoFormer D K, DuoFormer D, TopFormer F, etc. Any combination of various sheet forming methods are also possible.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
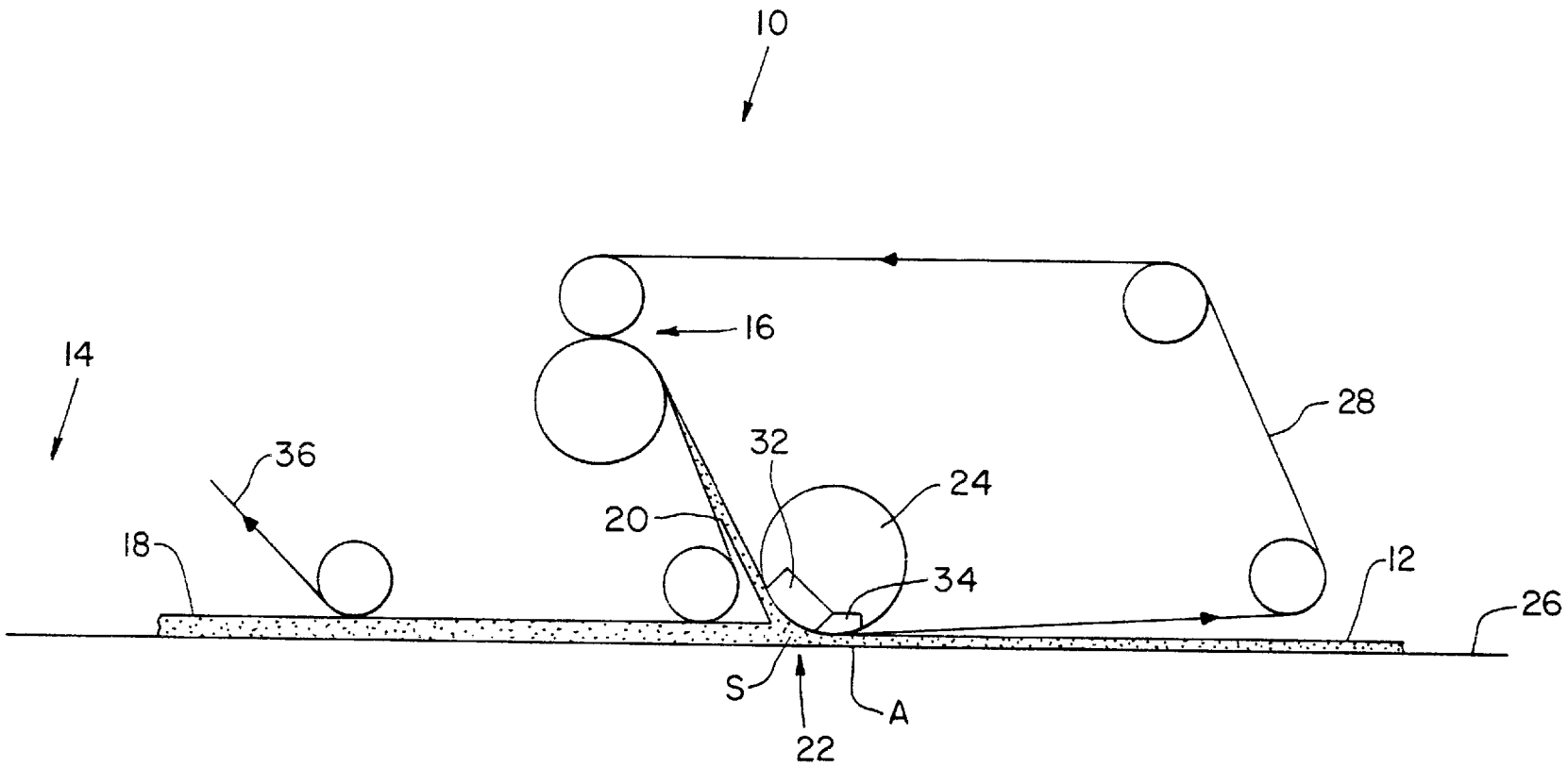
FIG. 1 is a schematic sectional illustration of a machine for the production of a multi-layer fiber stock web, in which two layers that are to be couched are supplied to a couch zone, which is comprised of a couch element in the form of a perforated cylinder.

Referring now to the drawings, and more particularly to FIG. 1, there is shown a machine for the production of a multi-layer fiber stock web 10.

Two layers or fiber stock webs 18 and 20, which are created in respective formers 14 and 16, are supplied to couch zone 22 in which they are couched together.

Couch zone 22 comprises perforated cylinder 24 which serves as a couching element and to which layers 18 and 20 are supplied by respective forming belts or wires 26 and 28.

For the purposes of this application a forming belt and a forming wire are functionally equivalent, and when either term is used in this application it shall also mean and refer to the other. As can be seen in FIG. 1, second forming belt or wire 28 supplying second layer 20 is guided around perforated cylinder 24. Perforated cylinder 24, together with second forming belt or wire 28, that is wrapped around perforated cylinder 24, is submerged into tensioned first forming belt or wire 26. Second forming belt or wire 28 runs onto perforated cylinder 24, prior to the point where second layer 20, comes into contact with the first layer 18.

Figure 2:
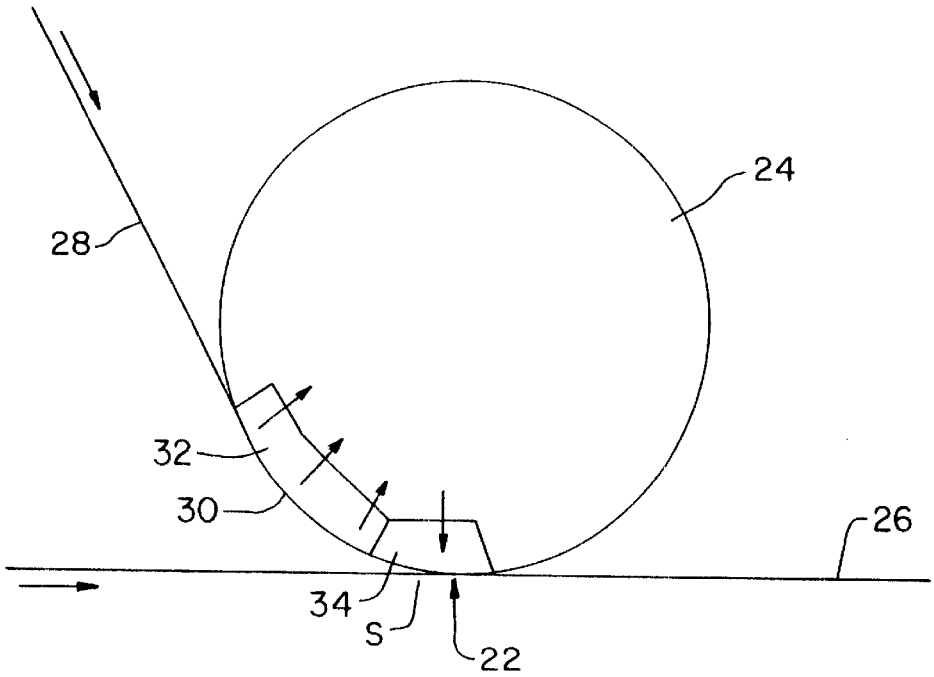
FIG. 2 is an enlarged illustration the couch zone equipped with a perforated cylinder, depicted in FIG. 1.

Referring additionally to FIG. 2, perforated cylinder 24 which is equipped with an at least partially open faced support area 30, including suction zone 32, through which second layer 20, at least in the area of point S, at which second layer 20 comes into contact with first layer 18, is supplied with suction through second forming belt or wire 28, and is accordingly admitted to second forming belt or wire 28. Second layer 20 therefore, is supplied in the direction of perforated cylinder 24, and is held onto second forming belt or wire 28 in an area in which it is diverted by and wraps around perforated cylinder 24.

Suction zone 32 is supplied with an interior pressure which is lower than the ambient pressure.

Following perforated cylinder 24, second layer 20 is accepted by first forming belt or wire 26, which is supplying first layer 18. Second forming belt or wire 28 is separated from first forming belt or wire 18 in discharge area A of perforated cylinder 24.

Perforated cylinder 24 is additionally equipped with pressure zone 34 in order to push second layer 20 away from perforated cylinder 24 by means of fluid over-pressure in the area in which forming belts or wires 26 and 28 are discharged from perforated cylinder 24. Possible sources of fluid over-pressure include air and steam.

Another embodiment of the invention includes a GapFormer as second former 16. Other formers are however, feasible. This also applies to first GapFormer 14, which is indicated only by an arrow in this example. Combinations of various formers 14 and 16 are feasible.

As can be seen in FIG. 1, additional forming belt or wire 36 that is allocated to former 16, is separated from second forming belt or wire 28, before the wire runs onto perforated cylinder 24.

The present invention may include a support area 30 having a circular-cylindrical progression.

Figure 3:
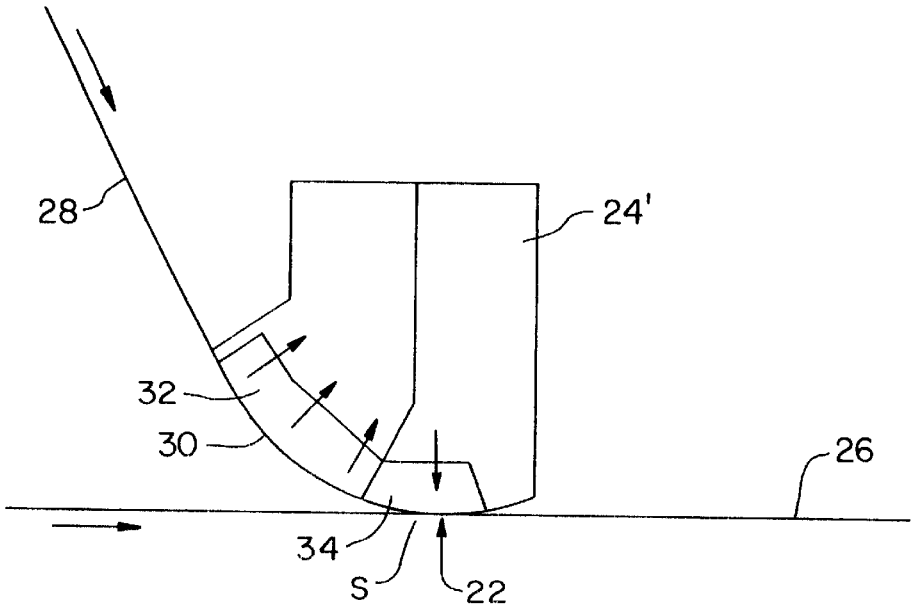
FIG. 3 is an illustration of the couch zone, comparable to FIG. 2, whereby however, the couch element is a guide shoe.

Now additionally referring to FIG. 3 there is another embodiment of the present invention wherein couch zone 22, which is comparable with FIG. 2, whereby the couch element however is guide shoe 24'.

Guide shoe 24' is also equipped with suction zone 32 and pressure zone 34. Support surface area 30, which is at least partially open faced, is curved differently in the area of zones 32 and 34. For example the radius of curvature, at least at the beginning of suction 32, is larger than in the area of pressure zone 34.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for the production of a multi-layer fiber stock web, comprising:

a first former including a first forming wire, said first former configured to form and convey a first fiber layer;

a second former including a second forming wire, said second former configured to form and convey said second fiber layer;

a couch element being a shoe, said second forming wire being guided around said couch element, said first forming wire configured to convey said first fiber layer to a place of contact with said second fiber layer, said place of contact defining a couch zone, said couch element and said second forming wire being configured to be in contact prior to said couch zone; and a suction device configured to provide suction through said second forming wire to said second fiber layer in said couch zone.

2. The machine of claim 1, wherein said couch element includes at least one pressure discharge element, said second wire conveying said second fiber layer from said second former to said couch element so as to encounter said pressure discharge element.

3. The machine of claim 1, wherein said machine is configured such that said second fiber layer is supplied in one of an area in which said second fiber layer is deflected by said couch element and an area in which said second fiber layer wraps around said couch element.

4. The machine of claim 1, wherein said couch element is a support element, said support element having a partially open face and a hollow interior, said support element being configured to accept an interior pressure of less than ambient pressure.

5. The machine of claim 4, wherein said support element includes said suction device, said support element configured to provide suction to said second fiber layer.

6. The machine of claim 1, wherein said machine is configured such that said first wire conveys said second fiber layer following said couch element.

7. The machine of claim 1, wherein said machine is configured such that said second wire separates from said first wire in an area of said couch element.

8. The machine of claim 1, wherein said couch element includes at least one pressure discharge element which acts on an area defining at least one pressure discharge zone.

9. The machine of claim 8, configured such that said second fiber layer is acted upon by a fluid medium in at least one said pressure discharge zone.

10. The machine of claim 8, wherein at least one of said at least one pressure discharge element delivers fluid under pressure in at least one said pressure discharge zone.

11. A method for the production of a multi-layer fiber web, comprising the steps of:

forming a first fiber layer on a first wire;

forming a second fiber layer on a second wire;

delivering said second fiber layer by way of said second wire to a couch element in the form of a shoe, such that said second wire is in contact with said couch element prior to said second fiber layer contacting said first fiber layer;

couching said second fiber layer to said first fiber layer using said couch element; and applying a suction force to said second fiber layer through said second wire in an area where said second fiber layer contacts said first fiber layer.

12. The method of claim 11, wherein said couch element includes at least one pressure discharge element, said second fiber layer being supplied from said second former to said couch element so as to encounter said pressure discharge element.

13. The method of claim 11, wherein said second fiber layer is supplied in one of an area in which said second fiber layer is deflected by said couch element and an area in which said second fiber layer wraps around said couch element.

14. The method of claim 11, wherein said couch element is a support element, said support element having a partially open face and a hollow interior with a pressure less than ambient.

15. The method of claim 14, wherein said applying step is accomplished utilizing said support element.

16. The method of claim 11, wherein said first wire conveys said second fiber layer following said couch element.

17. The method of claim 11, wherein said second wire separates from said first wire in an area of said couch element.

18. The method of claim 11, further comprising the step of discharging pressure in said couch element using at least one pressure discharge element, said pressure discharge element acting on an area defined as at least one pressure discharge zone.

19. The method of claim 18, wherein said discharging step uses a fluid medium in at least one said pressure discharge zone to act upon said second fiber layer.

20. The method of claim 18, wherein said discharging step uses pressurized fluid in at least one said pressure discharge zone.

* * * * *